US008187089B2

(12) United States Patent
Englman et al.

(10) Patent No.: US 8,187,089 B2
(45) Date of Patent: May 29, 2012

(54) WAGERING GAME PROVIDING PLAYER OPTIONS FOR TIME-BASED SPECIAL EVENT

(75) Inventors: Allon G. Englman, Chicago, IL (US); Jeremy M. Homik, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 286 days.

(21) Appl. No.: 12/716,751

(22) Filed: Mar. 3, 2010

(65) Prior Publication Data

US 2010/0227667 A1 Sep. 9, 2010

Related U.S. Application Data

(60) Provisional application No. 61/156,983, filed on Mar. 3, 2009.

(51) Int. Cl.
*A63F 9/00* (2006.01)

(52) U.S. Cl. ..... 463/25

(58) Field of Classification Search ..... None
See application file for complete search history.

(56) References Cited

U.S. PATENT DOCUMENTS

| | | | | |
|---|---|---|---|---|
| 4,624,459 | A | 11/1986 | Kaufman | 273/143 R |
| 4,837,728 | A | 6/1989 | Barrie et al. | 364/412 |
| 4,861,041 | A | 8/1989 | Jones et al. | 273/292 |
| 4,948,134 | A | 8/1990 | Suttle et al. | 273/85 |
| 5,116,055 | A | 5/1992 | Tracy | 273/138 A |
| 5,249,800 | A | 10/1993 | Hilgendorf et al. | 273/138 A |
| 5,275,400 | A | 1/1994 | Weingardt | 273/85 |
| 5,280,909 | A | 1/1994 | Tracy | 273/138 A |
| 5,344,144 | A | 9/1994 | Canon | 273/138 A |
| 5,377,973 | A | 1/1995 | Jones et al. | 273/85 CP |
| 5,393,057 | A | 2/1995 | Marnell, II | 273/85 CP |
| 5,417,430 | A | 5/1995 | Breeding | 273/292 |
| 5,482,289 | A | 1/1996 | Weingardt | 273/269 |
| 5,524,888 | A | 6/1996 | Heidel | 463/22 |
| 5,554,892 | A | 9/1996 | Norimatsu | 307/115 |

(Continued)

FOREIGN PATENT DOCUMENTS

CA 2334546 A1 8/2001

(Continued)

OTHER PUBLICATIONS

Article for "Easy Riches" by Sigma Game, Strictly Slots, 1 page (Aug. 2001).
Article for "Millioniser" by Glenn Haussman, Strictly Slots, pp. 50-53 (Mar. 2004).
Product Sheet for "Big Games Safari," IGT, 24 pages (2000).

(Continued)

*Primary Examiner* — Melba Bumgarner
*Assistant Examiner* — Seng H Lim
(74) *Attorney, Agent, or Firm* — Nixon Peabody LLP

(57) ABSTRACT

A gaming system for playing a wagering game includes a display for displaying a base game of the wagering game in response to receiving a play wager from a player. The gaming system further includes a controller coupled to the display and programmed to determine a bonus multiplier and a bonus eligibility time for the player based on a base wager. At least one of the bonus multiplier and the bonus eligibility time is a function of both the base wager and the play wager. A bonus game is triggered and, if sufficient bonus eligibility time is available to the player when the bonus game is triggered, the player is allowed to participate in the bonus game. In response to receiving a player selection, the bonus multiplier is modified based on changes to the bonus eligibility time.

17 Claims, 12 Drawing Sheets

U.S. PATENT DOCUMENTS

| | | | | |
|---|---|---|---|---|
| 5,564,700 | A | 10/1996 | Celona | 463/27 |
| 5,577,731 | A | 11/1996 | Jones | 273/292 |
| 5,577,959 | A | 11/1996 | Takemoto | 463/25 |
| 5,580,063 | A | 12/1996 | Edwards | 273/378 |
| 5,580,309 | A | 12/1996 | Piechowiak et al. | 463/16 |
| 5,611,730 | A | 3/1997 | Weiss | 463/20 |
| 5,645,486 | A | 7/1997 | Nagao et al. | 463/27 |
| 5,647,592 | A | 7/1997 | Gerow | 463/139 |
| 5,655,961 | A | 8/1997 | Acres et al. | 463/27 |
| 5,722,890 | A | 3/1998 | Libby et al. | 463/17 |
| 5,743,800 | A | 4/1998 | Huard et al. | 463/26 |
| 5,766,076 | A | 6/1998 | Pease et al. | 463/27 |
| RE35,864 | E | 7/1998 | Weingardt | 463/27 |
| 5,779,549 | A | 7/1998 | Walker et al. | 463/42 |
| 5,816,918 | A | 10/1998 | Kelly et al. | 463/16 |
| 5,820,459 | A | 10/1998 | Acres et al. | 463/25 |
| 5,823,874 | A | 10/1998 | Adams | 463/17 |
| 5,830,063 | A | 11/1998 | Acres et al. | 463/25 |
| 5,839,956 | A | 11/1998 | Takemoto | 463/18 |
| 5,848,932 | A | 12/1998 | Adams | 463/20 |
| 5,851,011 | A | 12/1998 | Lott | 273/292 |
| 5,851,147 | A | 12/1998 | Stupak | 463/13 |
| 5,855,515 | A | 1/1999 | Pease et al. | 463/27 |
| 5,876,284 | A | 3/1999 | Acres et al. | 463/25 |
| 5,885,158 | A | 3/1999 | Torango et al. | 463/25 |
| 5,941,773 | A | 8/1999 | Harlick | 463/26 |
| 5,944,606 | A | 8/1999 | Gerow | 463/27 |
| 5,951,011 | A | 9/1999 | Potter et al. | 273/292 |
| 5,975,528 | A | 11/1999 | Halaby | 273/148 |
| 5,993,316 | A | 11/1999 | Coyle et al. | 463/25 |
| 6,000,699 | A | 12/1999 | Long | 273/292 |
| 6,003,013 | A | 12/1999 | Boushy et al. | 705/10 |
| 6,007,427 | A | 12/1999 | Wiener et al. | 463/17 |
| 6,012,982 | A | 1/2000 | Piechowiak et al. | 463/16 |
| 6,020,884 | A | 2/2000 | MacNaughton et al. | 345/329 |
| 6,032,955 | A | 3/2000 | Luciano et al. | 273/138.1 |
| 6,039,648 | A | 3/2000 | Guinn et al. | 463/16 |
| 6,047,963 | A | 4/2000 | Pierce et al. | 273/121 B |
| 6,077,162 | A | 6/2000 | Weiss | 463/26 |
| 6,089,976 | A | 7/2000 | Schnieder et al. | 463/16 |
| 6,089,977 | A | 7/2000 | Bennett | 463/20 |
| 6,089,980 | A | 7/2000 | Gauselmann | 463/27 |
| 6,102,474 | A | 8/2000 | Daley | 296/836 |
| 6,102,798 | A | 8/2000 | Bennett | 463/16 |
| 6,102,799 | A | 8/2000 | Stupak | 463/27 |
| 6,105,964 | A | 8/2000 | Maahs | 273/292 |
| 6,110,043 | A | 8/2000 | Olsen | 463/27 |
| 6,139,013 | A | 10/2000 | Pierce et al. | 273/121 B |
| 6,142,872 | A | 11/2000 | Walker et al. | 463/16 |
| 6,146,273 | A | 11/2000 | Olsen | 463/27 |
| 6,155,925 | A | 12/2000 | Giobbi et al. | 463/20 |
| 6,158,741 | A | 12/2000 | Koelling | 273/292 |
| 6,159,097 | A | 12/2000 | Gura | 463/20 |
| 6,168,155 | B1 | 1/2001 | Kuhlman et al. | 273/144 |
| 6,168,523 | B1 | 1/2001 | Piechowiak et al. | 463/26 |
| 6,203,010 | B1 | 3/2001 | Jorasch et al. | 273/138.1 |
| 6,203,429 | B1 | 3/2001 | Demar et al. | 463/20 |
| 6,206,374 | B1 | 3/2001 | Jones | 463/26 |
| 6,206,782 | B1 | 3/2001 | Walker et al. | 463/25 |
| 6,210,275 | B1 | 4/2001 | Olsen | 463/16 |
| 6,210,277 | B1 | 4/2001 | Stefan | 463/27 |
| 6,217,448 | B1 | 4/2001 | Olsen | 463/25 |
| 6,220,593 | B1 | 4/2001 | Pierce et al. | 273/138.1 |
| 6,224,482 | B1 | 5/2001 | Bennett | 463/20 |
| 6,224,484 | B1 | 5/2001 | Okuda et al. | 463/27 |
| 6,231,445 | B1 | 5/2001 | Acres | 463/27 |
| 6,241,608 | B1 | 6/2001 | Torango | 463/27 |
| 6,254,483 | B1 | 7/2001 | Acres | 463/26 |
| 6,299,533 | B1 | 10/2001 | Parra et al. | 463/17 |
| 6,312,332 | B1 | 11/2001 | Walker et al. | 463/23 |
| 6,315,660 | B1 | 11/2001 | DeMar et al. | 463/16 |
| 6,319,125 | B1 | 11/2001 | Acres | 463/25 |
| 6,319,127 | B1 | 11/2001 | Walker et al. | 463/26 |
| 6,331,148 | B1 | 12/2001 | Krause et al. | 473/274 |
| 6,336,857 | B1 | 1/2002 | McBride | 463/12 |
| 6,336,859 | B2 | 1/2002 | Jones et al. | 463/42 |
| 6,336,862 | B1 | 1/2002 | Byrne | 463/27 |
| 6,345,824 | B1 | 2/2002 | Selitzky | 273/292 |
| 6,347,996 | B1 | 2/2002 | Gilmore et al. | 463/17 |
| 6,352,479 | B1 | 3/2002 | Sparks, II | 463/42 |
| 6,358,149 | B1 | 3/2002 | Schneider et al. | 463/27 |
| 6,361,441 | B1 | 3/2002 | Walker et al. | 463/42 |
| 6,364,768 | B1 | 4/2002 | Acres et al. | 463/25 |
| 6,375,567 | B1 | 4/2002 | Acres | 463/25 |
| 6,375,568 | B1 | 4/2002 | Roffman et al. | 463/26 |
| 6,406,369 | B1 | 6/2002 | Baerlocher et al. | 463/20 |
| 6,409,602 | B1 | 6/2002 | Wiltshire et al. | 463/42 |
| 6,416,408 | B2 | 7/2002 | Tracy et al. | 463/29 |
| 6,416,409 | B1 | 7/2002 | Jordan | 463/27 |
| 6,422,940 | B1 | 7/2002 | Walker et al. | 463/13 |
| 6,431,983 | B2 | 8/2002 | Acres | 463/25 |
| 6,435,510 | B2 | 8/2002 | Moore | 273/292 |
| 6,435,968 | B1 | 8/2002 | Torango | 463/27 |
| 6,439,995 | B1 | 8/2002 | Hughs-Baird et al. | 463/20 |
| 6,482,089 | B2 | 11/2002 | DeMar et al. | 463/20 |
| 6,506,117 | B2 | 1/2003 | DeMar et al. | 463/20 |
| 6,507,709 | B2 | 1/2003 | Karmarker | 463/42 |
| 6,508,707 | B2 | 1/2003 | DeMar et al. | 463/16 |
| 6,517,433 | B2 | 2/2003 | Loose et al. | 463/20 |
| 6,520,855 | B2 | 2/2003 | DeMar et al. | 463/20 |
| 6,569,016 | B1 | 5/2003 | Baerlocher | 463/16 |
| 6,577,733 | B1 | 6/2003 | Charrin | 380/251 |
| 6,589,115 | B2 | 7/2003 | Walker et al. | 463/25 |
| 6,592,458 | B1 | 7/2003 | Ho | 463/17 |
| 6,592,460 | B2 | 7/2003 | Torango | 463/27 |
| 6,599,186 | B1 | 7/2003 | Walker et al. | 463/17 |
| 6,599,188 | B2 | 7/2003 | Hirsch et al. | 463/19 |
| 6,599,193 | B2 | 7/2003 | Baerlocher et al. | 463/27 |
| 6,601,771 | B2 | 8/2003 | Charrin | 235/492 |
| 6,609,673 | B1 | 8/2003 | Johnson | 242/423 |
| 6,626,758 | B1 | 9/2003 | Parham et al. | 463/25 |
| 6,648,753 | B1 | 11/2003 | Tracy et al. | 463/16 |
| 6,648,762 | B2 | 11/2003 | Walker et al. | 463/25 |
| 6,652,378 | B2 | 11/2003 | Cannon et al. | 463/20 |
| 6,656,052 | B2 | 12/2003 | Abramopoulos et al. | 463/47 |
| 6,659,461 | B2 | 12/2003 | Yoseloff et al. | 273/274 |
| 6,676,513 | B2 | 1/2004 | Gauselmann | 463/20 |
| 6,685,560 | B1 | 2/2004 | Hughes | 463/16 |
| 6,692,353 | B2 | 2/2004 | Walker et al. | 463/30 |
| 6,712,695 | B2 | 3/2004 | Mothwurf et al. | 463/25 |
| 6,712,699 | B2 | 3/2004 | Walker et al. | 463/42 |
| 6,733,390 | B2 | 5/2004 | Walker et al. | 463/23 |
| 6,776,715 | B2 | 8/2004 | Price | 463/27 |
| 6,790,141 | B2 | 9/2004 | Muir | 463/42 |
| 6,837,793 | B2 | 1/2005 | McClintic | 463/42 |
| 6,869,361 | B2 | 3/2005 | Sharpless | 463/25 |
| 6,880,824 | B2 | 4/2005 | Thiinnes | 273/139 |
| 6,887,154 | B1 | 5/2005 | Luciano, Jr. et al. | 463/26 |
| 6,887,159 | B2 | 5/2005 | Leen et al. | 463/42 |
| 7,004,466 | B2 | 2/2006 | Gauselmann | 463/138 |
| 7,036,012 | B2 | 4/2006 | Charrin | 213/169 |
| 7,056,215 | B1 | 6/2006 | Olive | 463/27 |
| 7,255,645 | B2 | 8/2007 | Steil et al. | 463/27 |
| 7,300,351 | B2 * | 11/2007 | Thomas | 463/20 |
| 7,338,370 | B2 * | 3/2008 | Oles et al. | 463/25 |
| 7,510,473 | B2 * | 3/2009 | Thomas | 463/25 |
| 7,607,980 | B2 * | 10/2009 | Masci et al. | 463/20 |
| 7,662,040 | B2 | 2/2010 | Englman et al. | 463/42 |
| 7,674,174 | B2 * | 3/2010 | Marks et al. | 463/20 |
| 7,780,531 | B2 | 8/2010 | Englman et al. | 463/42 |
| 7,905,776 | B2 * | 3/2011 | Sines | 463/25 |
| 7,931,528 | B2 * | 4/2011 | Singer et al. | 463/16 |
| 8,092,299 | B2 * | 1/2012 | Cohen et al. | 463/20 |
| 2002/0132660 | A1 | 9/2002 | Taylor | 463/16 |
| 2002/0138594 | A1 | 9/2002 | Rowe | 709/219 |
| 2002/0151345 | A1 | 10/2002 | Byrne | 463/18 |
| 2002/0155874 | A1 | 10/2002 | Byrne | 463/16 |
| 2002/0187823 | A1 | 12/2002 | Khal | 463/13 |
| 2002/0195773 | A1 | 12/2002 | Dunn | 273/274 |
| 2003/0014370 | A1 | 1/2003 | Charrin | 17/60 |
| 2003/0027618 | A1 | 2/2003 | Byrne | 463/16 |
| 2003/0027625 | A1 | 2/2003 | Rowe | 463/20 |
| 2003/0030211 | A1 | 2/2003 | Brown | 273/139 |
| 2003/0036430 | A1 | 2/2003 | Cannon | 463/42 |
| 2003/0045337 | A1 | 3/2003 | Byrne | 463/16 |
| 2003/0047874 | A1 | 3/2003 | Leen et al. | 273/292 |
| 2003/0060106 | A1 | 3/2003 | Haggquist et al. | 442/131 |

| | | | | |
|---|---|---|---|---|
| 2003/0060266 | A1 | 3/2003 | Baerlocher | 463/20 |
| 2003/0064776 | A1 | 4/2003 | Byrne | 463/16 |
| 2003/0064807 | A1 | 4/2003 | Walker | 463/42 |
| 2003/0078091 | A1 | 4/2003 | Brandstetter et al. | 463/20 |
| 2003/0109306 | A1 | 6/2003 | Karmarkar | 463/40 |
| 2003/0114218 | A1 | 6/2003 | McClintic | 463/25 |
| 2003/0119576 | A1 | 6/2003 | McClintic | 463/20 |
| 2003/0148808 | A1 | 8/2003 | Price | 463/27 |
| 2003/0157978 | A1 | 8/2003 | Englman | 463/16 |
| 2003/0162585 | A1 | 8/2003 | Bigelow, Jr. et al. | 463/20 |
| 2003/0181231 | A1 | 9/2003 | Vancura et al. | 463/9 |
| 2003/0186733 | A1 | 10/2003 | Wolf et al. | 463/16 |
| 2003/0211884 | A1 | 11/2003 | Gauselmann | 463/20 |
| 2003/0216166 | A1 | 11/2003 | Baerlocher et al. | 463/20 |
| 2003/0222402 | A1 | 12/2003 | Olive | 273/292 |
| 2003/0224852 | A1 | 12/2003 | Walker | 463/20 |
| 2003/0228899 | A1 | 12/2003 | Evans | 463/25 |
| 2003/0236116 | A1 | 12/2003 | Marks et al. | 463/16 |
| 2004/0009808 | A1 | 1/2004 | Gauselmann | 463/25 |
| 2004/0009811 | A1 | 1/2004 | Torango | 463/25 |
| 2004/0023716 | A1 | 2/2004 | Gauselmann | 463/23 |
| 2004/0038741 | A1 | 2/2004 | Gauselmann | 463/42 |
| 2004/0048644 | A1 | 3/2004 | Gerrard et al. | 463/16 |
| 2004/0063484 | A1 | 4/2004 | Dreaper et al. | 463/16 |
| 2004/0087368 | A1 | 5/2004 | Gauselmann | 463/42 |
| 2004/0092304 | A1 | 5/2004 | George | 463/29 |
| 2004/0102238 | A1 | 5/2004 | Taylor | 463/16 |
| 2004/0102243 | A1 | 5/2004 | Olsen | 463/25 |
| 2004/0106448 | A1 | 6/2004 | Gauselmann | 463/25 |
| 2004/0132524 | A1 | 7/2004 | Ramstad et al. | 463/16 |
| 2004/0152511 | A1 | 8/2004 | Nicely et al. | 463/27 |
| 2004/0204226 | A1 | 10/2004 | Foster et al. | 463/20 |
| 2004/0204235 | A1 | 10/2004 | Walker et al. | 463/29 |
| 2004/0235552 | A1 | 11/2004 | Gauselman | 463/16 |
| 2004/0242297 | A1 | 12/2004 | Walker et al. | 463/16 |
| 2004/0242303 | A1 | 12/2004 | Walker et al. | 463/16 |
| 2004/0248651 | A1 | 12/2004 | Gagner et al. | 463/42 |
| 2005/0003880 | A1 | 1/2005 | Englman | 463/16 |
| 2005/0003886 | A1 | 1/2005 | Englman et al. | 463/25 |
| 2005/0014554 | A1 | 1/2005 | Walker | 463/20 |
| 2005/0017451 | A1 | 1/2005 | Ollington | 273/292 |
| 2005/0026674 | A1 | 2/2005 | Wolf et al. | 463/19 |
| 2005/0037837 | A1 | 2/2005 | Rowe | 463/25 |
| 2005/0055113 | A1 | 3/2005 | Gauselmann | 700/91 |
| 2005/0059467 | A1 | 3/2005 | Saffari et al. | 463/19 |
| 2005/0059472 | A1 | 3/2005 | Joshi et al. | 463/20 |
| 2005/0064930 | A1 | 3/2005 | Jubinville et al. | 463/17 |
| 2005/0075889 | A1 | 4/2005 | Gomes et al. | 705/1 |
| 2005/0096130 | A1 | 5/2005 | Mullins | 463/27 |
| 2005/0137010 | A1 | 6/2005 | Enzminger et al. | 463/25 |
| 2005/0148382 | A1 | 7/2005 | Fox | 463/19 |
| 2005/0159207 | A1 | 7/2005 | Thomas | 463/20 |
| 2005/0187008 | A1 | 8/2005 | Nakajima | 463/16 |
| 2005/0187014 | A1 | 8/2005 | Saffari et al. | 463/27 |
| 2005/0192073 | A1 | 9/2005 | Nakajima | 463/27 |
| 2005/0192088 | A1 | 9/2005 | Hartman et al. | 463/27 |
| 2005/0215313 | A1 | 9/2005 | O'Halloran | 463/26 |
| 2005/0282628 | A1 | 12/2005 | Beatty | 463/27 |
| 2006/0003829 | A1 | 1/2006 | Thomas | 463/20 |
| 2006/0009280 | A1 | 1/2006 | Joshi et al. | 463/25 |
| 2006/0009283 | A1 | 1/2006 | Englman et al. | 463/29 |
| 2006/0019737 | A1 | 1/2006 | Yang | 463/19 |
| 2006/0025195 | A1 | 2/2006 | Pennington et al. | 463/16 |
| 2006/0025210 | A1 | 2/2006 | Johnson | 463/25 |
| 2006/0030403 | A1 | 2/2006 | Lafky et al. | 463/27 |
| 2006/0035706 | A1 | 2/2006 | Thomas et al. | 463/27 |
| 2006/0052159 | A1 | 3/2006 | Cahill et al. | 463/27 |
| 2006/0073877 | A1 | 4/2006 | Rodgers et al. | 463/20 |
| 2006/0073889 | A1 | 4/2006 | Edidin et al. | 463/27 |
| 2006/0116201 | A1 | 6/2006 | Gausselmann | 463/26 |
| 2006/0121971 | A1 | 6/2006 | Slomiany | 463/16 |
| 2006/0135243 | A1 | 6/2006 | Englman et al. | 463/16 |
| 2006/0142079 | A1 | 6/2006 | Ikehara et al. | 463/27 |
| 2006/0142086 | A1 | 6/2006 | Blackburn et al. | 463/42 |
| 2006/0154718 | A1 | 7/2006 | Willyard et al. | 463/25 |
| 2006/0178203 | A1 | 8/2006 | Hughes et al. | 463/20 |
| 2006/0183535 | A1 | 8/2006 | Marks et al. | 463/20 |
| 2006/0183537 | A1 | 8/2006 | Dickerson | 463/27 |
| 2006/0183538 | A1 | 8/2006 | Michaelson et al. | 463/27 |
| 2006/0223611 | A1 | 10/2006 | Baerlocher et al. | 463/16 |
| 2006/0281527 | A1 | 12/2006 | Dunaevsky et al. | 463/20 |
| 2006/0287077 | A1 | 12/2006 | Grav et al. | 463/27 |
| 2007/0026941 | A1 | 2/2007 | Block et al. | 463/29 |
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |
| 2007/0072665 | A1 | 3/2007 | Muir | 463/12 |
| 2007/0105617 | A1* | 5/2007 | Walker et al. | 463/25 |
| 2007/0135193 | A1 | 6/2007 | Nicely | 463/11 |
| 2007/0259711 | A1 | 11/2007 | Thomas | 463/22 |
| 2007/0281778 | A1 | 12/2007 | Bigelow, Jr. et al. | 463/20 |
| 2008/0045341 | A1 | 2/2008 | Englman | 463/42 |
| 2008/0058089 | A1 | 3/2008 | Schwartz et al. | 463/22 |
| 2008/0058091 | A1 | 3/2008 | Schwartz et al. | 463/25 |
| 2008/0058099 | A1 | 3/2008 | Schwartz et al. | 463/29 |
| 2008/0064491 | A1 | 3/2008 | Taylor | 463/25 |
| 2008/0102921 | A1 | 5/2008 | Urquhart | 463/20 |
| 2008/0113742 | A1 | 5/2008 | Amos et al. | 463/20 |
| 2008/0119283 | A1 | 5/2008 | Baerlocher | 463/42 |
| 2008/0153564 | A1 | 6/2008 | Baerlocher et al. | 463/16 |
| 2008/0200237 | A1 | 8/2008 | Cuddly et al. | 463/20 |
| 2008/0234041 | A1* | 9/2008 | Berman | 463/27 |
| 2008/0274789 | A1 | 11/2008 | Singer et al. | 463/20 |
| 2009/0042641 | A1 | 2/2009 | Anderson et al. | 463/25 |
| 2009/0104954 | A1 | 4/2009 | Weber et al. | 463/1 |
| 2009/0118006 | A1 | 5/2009 | Kelly et al. | 463/31 |
| 2009/0124371 | A1 | 5/2009 | Gilmore et al. | 463/27 |
| 2009/0149241 | A1* | 6/2009 | Thomas | 463/20 |
| 2009/0156303 | A1 | 6/2009 | Kiely et al. | 463/29 |
| 2009/0233705 | A1 | 9/2009 | LeMay et al. | 463/25 |
| 2009/0253483 | A1 | 10/2009 | Pacey et al. | 463/20 |
| 2009/0253492 | A1 | 10/2009 | Caputo et al. | 463/20 |
| 2010/0009742 | A1* | 1/2010 | Popovich et al. | 463/25 |
| 2010/0041462 | A1* | 2/2010 | Singer et al. | 463/20 |
| 2011/0218033 | A1* | 9/2011 | Englman et al. | 463/25 |

FOREIGN PATENT DOCUMENTS

| | | | |
|---|---|---|---|
| DE | 195 15 983 | A1 | 11/1996 |
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2 313 792 | A | 12/1997 |
| GB | 2 333 880 | | 8/1999 |
| GB | 2 350 715 | A | 12/2000 |
| WO | WO 99/03078 | A1 | 1/1999 |
| WO | WO 99/15246 | | 4/1999 |
| WO | WO 99/19037 | A1 | 4/1999 |
| WO | WO 01/33478 | A1 | 5/2001 |
| WO | WO 03/026754 | A1 | 4/2003 |
| WO | WO 03/083789 | A1 | 10/2003 |
| WO | WO 2005/113088 | A1 | 12/2005 |
| WO | WO 2006/014770 | A2 | 2/2006 |
| WO | WO 2006/014990 | A2 | 2/2006 |
| WO | WO 2006/039349 | A2 | 4/2006 |
| WO | WO 2006/121663 | A2 | 11/2006 |
| WO | WO 2007/117502 | A2 | 10/2007 |
| WO | WO 2009/061386 | A1 | 5/2009 |

OTHER PUBLICATIONS

"New '97 Games," International Gaming & Wagering Business, 24 pages (Mar. 1997).

PCT International Search Report for International Application No. PCT/US2005/015687 dated Oct. 28, 2005 (2 pages).

PCT International Search Report for International Application No. PCT/US2006/016536 dated Oct. 5, 2006 (3 pages).

International Search Report—PCT/US06/20979 dated Nov. 13, 2006 (2 pages).

PCT International Search Report for International Application No. PCT/US2006/34407 dated Sep. 28, 2007 (2 pages).

* cited by examiner

| Base Wager | Player Wager | Multiplier | Weighted Probability |
|---|---|---|---|
| 30 | 10 | None OR 1X | 66% Chance for No Multiplier |
| | | | 33% Chance for 1X Multiplier |
| 30 | 15 | None OR 1X | 50% Chance for No Multiplier |
| | | | 50% Chance for 1X Multiplier |
| 30 | 20 | None OR 1X | 33% Chance for No Multiplier |
| | | | 66% Chance for 1X Multiplier |
| 30 | 25 | None OR 1X | 17% Chance for No Multiplier |
| | | | 83% Chance for 1X Multiplier |
| 30 | 30 | 1X | 100% Chance for 1X Multiplier |
| 30 | 40 | 1X OR 2X | 66% Chance for 1X Multiplier |
| | | | 33% Chance for 2X Multiplier |
| 30 | 45 | 1X OR 2X | 50% Chance for 1X Multiplier |
| | | | 50% Chance for 2X Multiplier |
| 30 | 60 | 2X | 100% Chance for 2X Multiplier |

FIG. 4E

WAGERING GAME PROVIDING PLAYER OPTIONS FOR TIME-BASED SPECIAL EVENT

RELATED APPLICATIONS

This application is related to and claims priority to U.S. Provisional Patent Application Ser. No. 61/156,983, filed Mar. 3, 2009, and titled "Wagering Game Providing Player Options For Time-Based Special Event," which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to an emotive lighting arrangement integrated in a gaming cabinet for providing ambient lighting to a gaming environment.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming system for playing a wagering game includes a display for displaying a base game of the wagering game in response to receiving a play wager from a player. The gaming system further includes a controller coupled to the display and programmed to determine a bonus multiplier and a bonus eligibility time for the player based on a base wager. At least one of the bonus multiplier and the bonus eligibility time is a function of both the base wager and the play wager. A bonus game is triggered and, if sufficient bonus eligibility time is available to the player when the bonus game is triggered, the player is allowed to participate in the bonus game. In response to receiving a player selection, the bonus multiplier is modified based on changes to the bonus eligibility time.

According to yet another aspect of the invention, a method of conducting a wagering game via a gaming machine includes receiving a play wager from a player for playing a base game of the wagering game. In response to receiving the player wager, the base game is displayed on a display of the gaming machine. The method further includes determining a bonus multiplier and a bonus eligibility time for the player based on a base wager, at least one of the bonus multiplier and the bonus eligibility time being a function of both the base wager and the play wager. A bonus game is triggered in response to a bonus triggering event and, if sufficient bonus eligibility time is available to the player when the bonus game is triggered, the player is allowed to participate in the bonus game. In response to player adjustment to the bonus eligibility time, the bonus multiplier is modified.

According to yet another aspect of the invention, a gaming system for playing a wagering game includes a display and a controller. The display displays a base game of the wagering game in response to receiving a play wager from a player. The controller is coupled to the display and is programmed to receive a selection from an operator to set a base wager, and to determine a bonus multiplier and a bonus eligibility time for the player. Each of the bonus multiplier and the bonus eligibility time is a function of both the base wager and the play wager. A bonus game is triggered in response to a bonus triggering event, and, if sufficient bonus eligibility time is available to the player when the bonus game is triggered, the player is allowed to participate in the bonus game. Any awards received in the bonus game are multiplied in accordance with the bonus multiplier.

According to yet another aspect of the invention, a gaming system for playing a wagering game includes a display and a controller. The display displays a base game of the wagering game in response to receiving a play wager from a player. The controller is coupled to the display and is programmed to trigger a time-based bonus game in response to a bonus triggering event. The bonus game includes a bonus multiplier for the player, the bonus multiplier being a multiplication factor that multiplies a bonus award to result in a multiplied bonus award. If sufficient bonus eligibility time is available to the player when the bonus game is triggered, the player is allowed to participate in the bonus game. The controller is further programmed to determine a bonus multiplier for the player as a function of a base wager and the play wager. If the play wager is a whole number multiple of the base wager, a value is provided for the bonus multiplier that is equivalent to the whole number multiple. if the play wager includes a non-whole number multiple of the base wager, a value is provided for the bonus multiplier that is determined in accordance with a weighted probability, the weighted probability corresponding to the non-whole number multiple.

According to yet another aspect of the invention, a method of conducting a wagering game on a gaming machine includes receiving a play wager from a player for playing a base game of the wagering game. The base game is displayed on the display of the gaming machine. A time-based bonus game is triggered in response to a bonus triggering event. The bonus game is displayed on the display of the same display as the base game, or on another display of the gaming machine. If sufficient bonus eligibility time is available to the player when the bonus game is triggered, the player is allowed to participate in the bonus game. The player provides play inputs via one or more game buttons of the gaming machine. A bonus multiplier N is determined for the player as a function of a base wager B and the play wager. If the play wager includes a non-whole multiple Z of the base wager B such that the play wager is Z+N*B, the bonus multiplier N is selected to be a next higher bonus multiplier N' based on a weighted probability that is equivalent to Z/B.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 4E shows a weighted probability table;

DETAILED DESCRIPTION

Figure 1A:
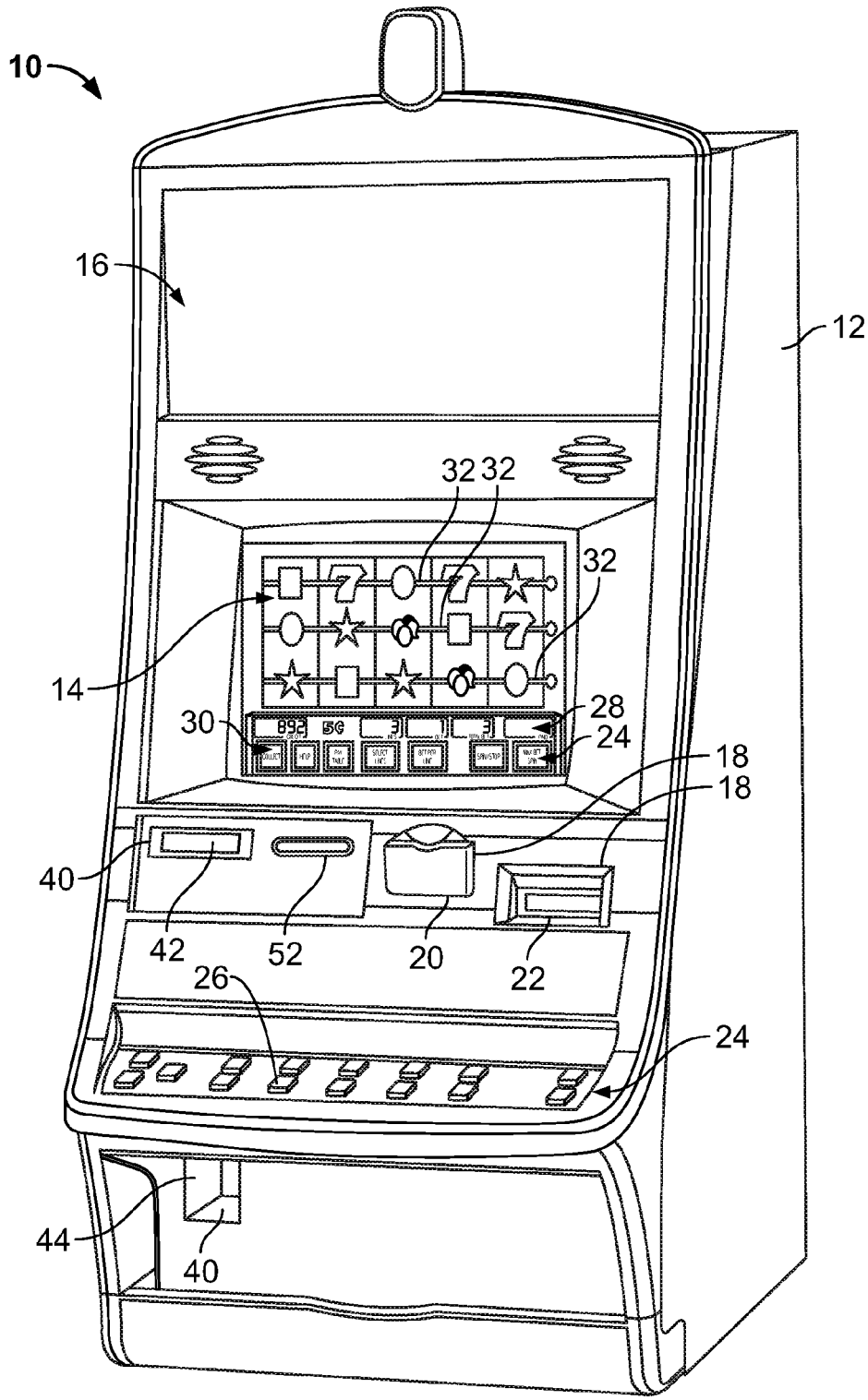
FIG. 1A is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1A, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1A). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1A, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 29. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10. Alternatively yet, in the "slant-top" version of the gaming machine the primary display 14 may be oriented in an upright position (i.e., in a generally vertical position or nearly vertical position).

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 29 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1A as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
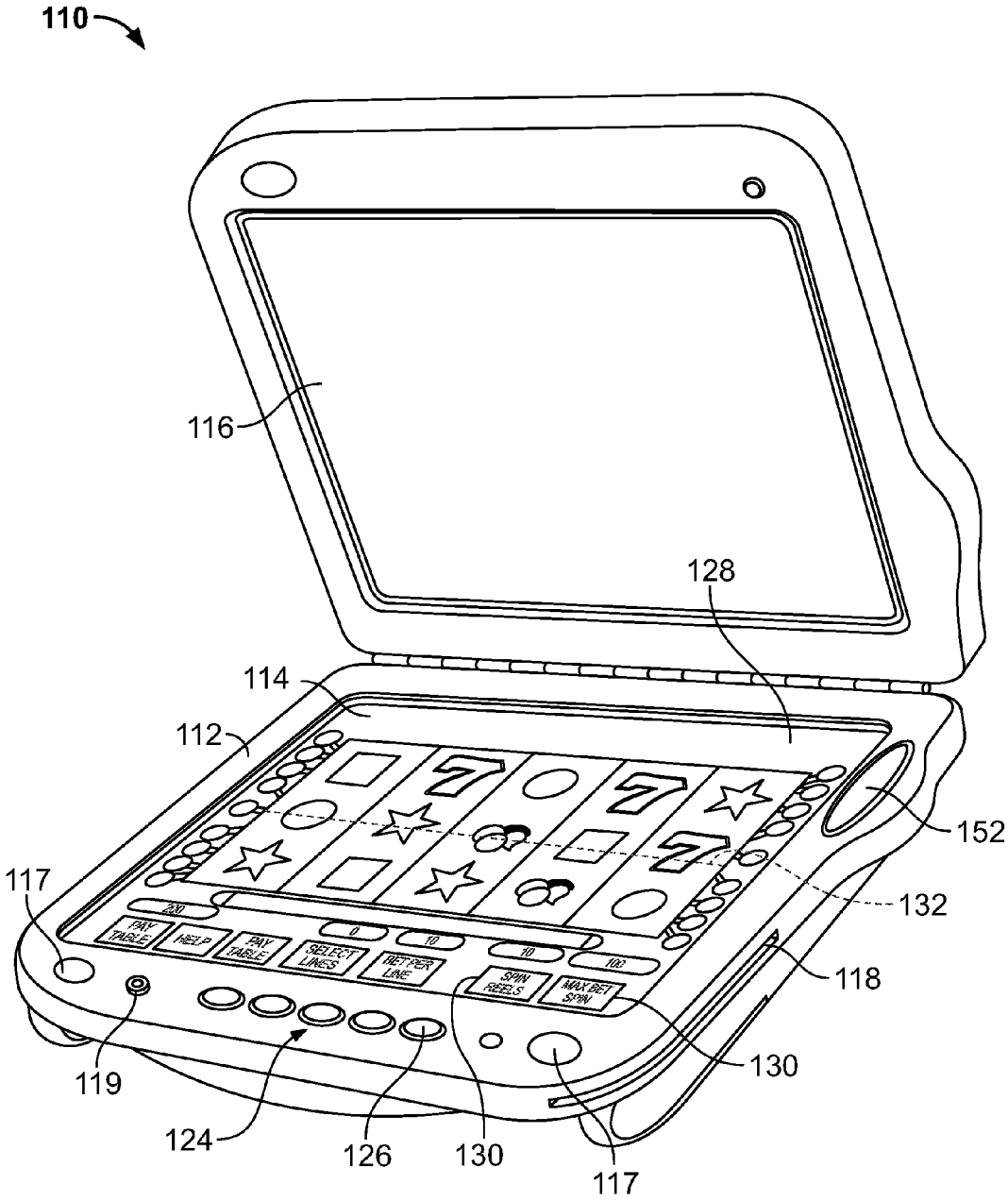
FIG. 1B is a perspective view of a handheld gaming machine embodying the present invention.

Depicted in FIG. 1B is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1B, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1B, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 129 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1B, comprises a biometric sensing device.

Figure 2:
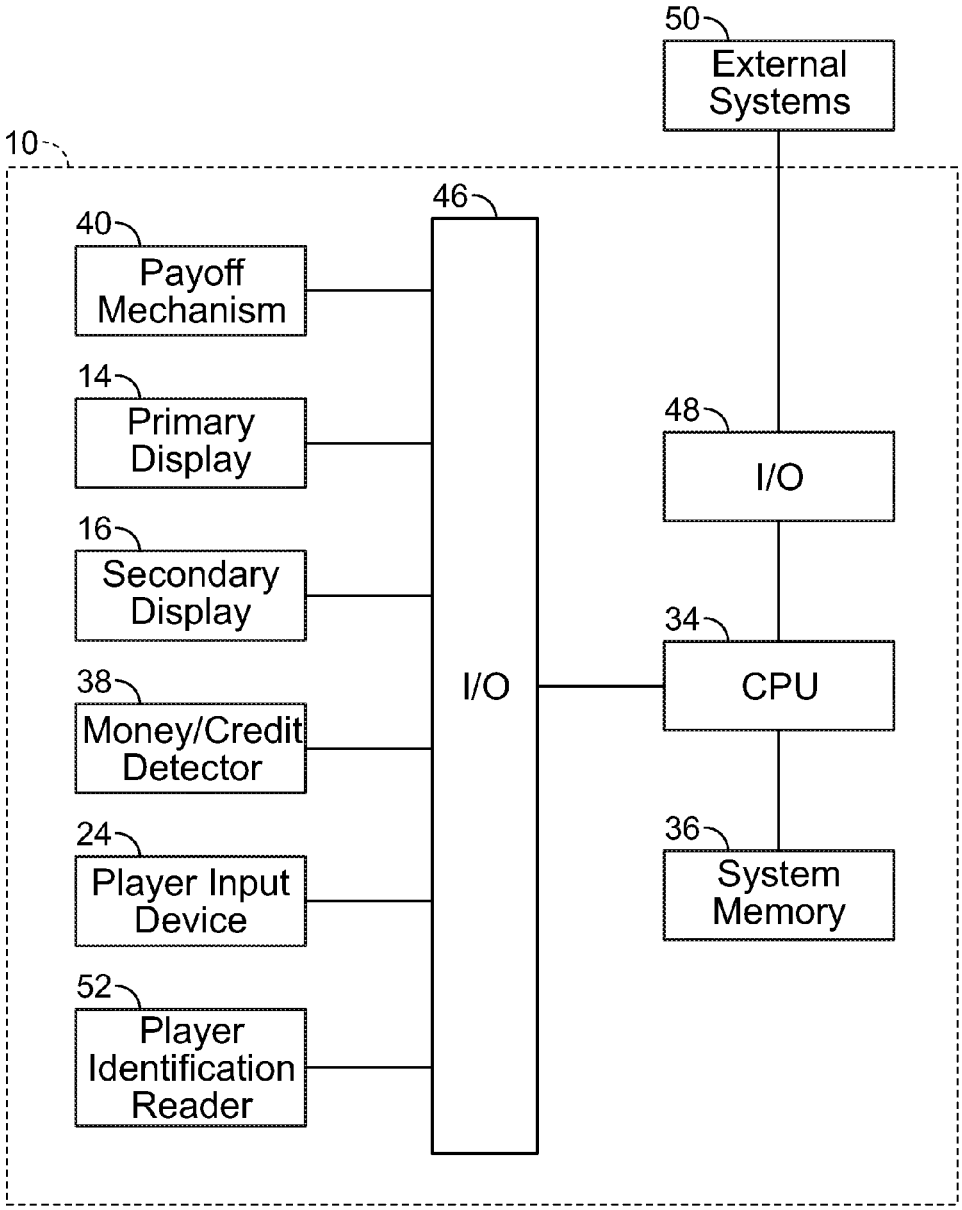
FIG. 2 is a block diagram of a control system suitable for operating the gaming machines of FIGS. 1A and 1B.

Turning now to FIG. 2, the various components of the gaming machine 10 are controlled by a central processing unit (CPU) 39, also referred to herein as a controller or processor (such as a microcontroller or microprocessor). To provide gaming functions, the controller 39 executes one or more game programs stored in a computer readable storage medium, in the form of memory 36. The controller 39 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 39 may include one or more microprocessors, including but not limited to a master processor, a slave processor, and a secondary or parallel processor.

The controller 39 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 39 is also connected to, and controls, the primary display 14, the player input device 24, and a payoff mechanism 40. The payoff mechanism 40 is operable in response to instructions from the controller 39 to award a payoff to the player in response to certain winning outcomes that might occur in the basic game or the bonus game(s). The payoff may be provided in the form of points, bills, tickets, coupons, cards, etc. For example, in FIG. 1A, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 39 and both the peripheral components of the gaming machine 10 and external systems 50 occur through input/output (I/O) circuits 46, 48. More specifically, the controller 39 controls and receives inputs from the peripheral components of the gaming machine 10 through the input/output circuits 46. Further, the controller 39 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 39, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 39 may comprise one or more controllers or processors. In FIG. 2, the controller 39 in the gaming machine 10 is depicted as comprising a CPU, but the controller 39 may alternatively comprise a CPU in combination with other components, such as the I/O circuits 46, 48 and the system memory 36. The controller 39 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 39 on board the gaming machine processes display information to be displayed on the display(s) of the machine. In an alternative "rich client" configuration, the server determines game outcomes, while the controller 39 on board the gaming machine executes game code and processes display information to be displayed on the display(s) of the machines. In yet another alternative "thick client" configuration, the controller 39 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, Establishing Wireless Robust Security Networks: A Guide to IEEE 802.11, and SP 800-48, Wireless Network Security: 802.11, Bluetooth and Handheld Devices, both of which are incorporated herein by reference in their entirety.

Figure 3:
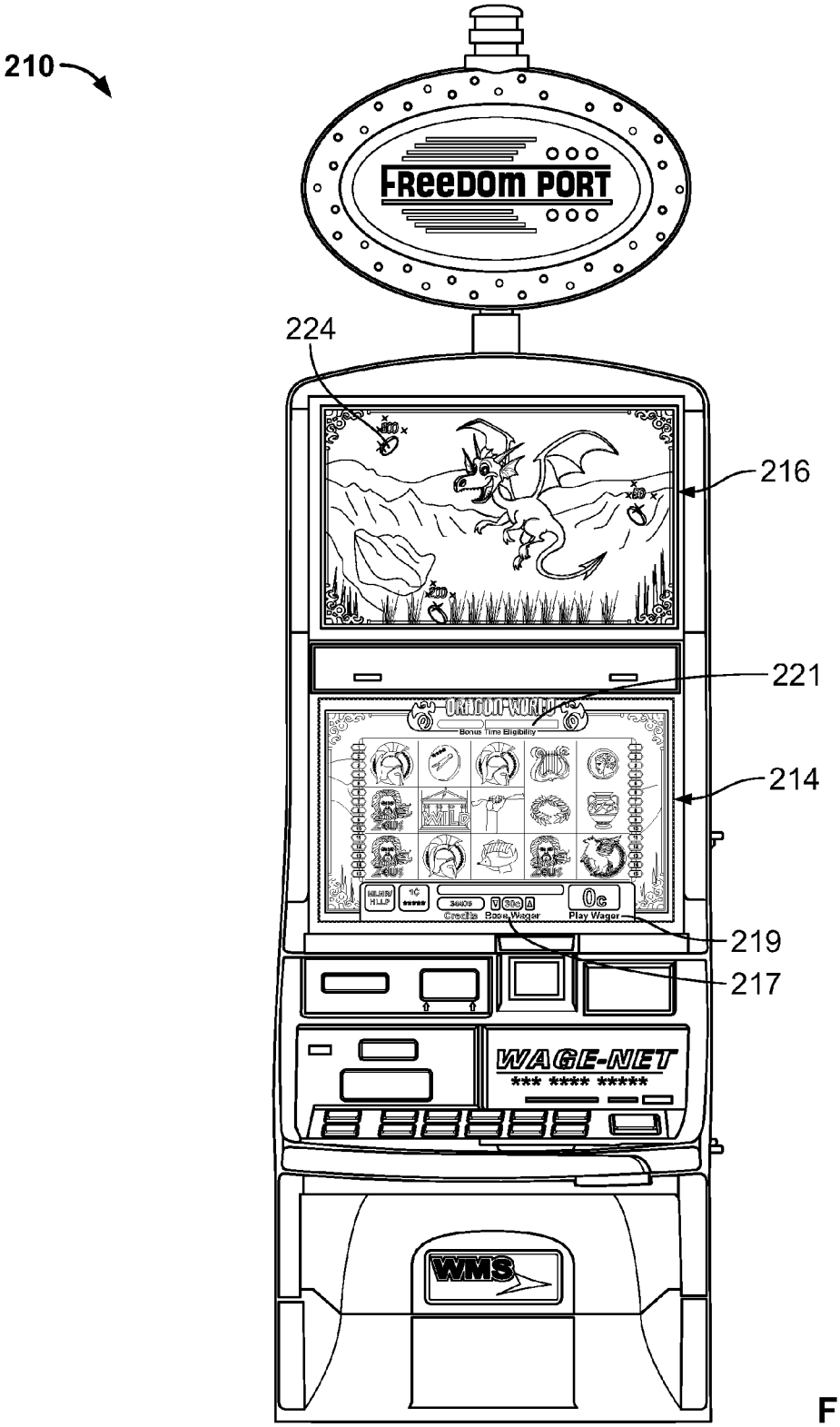
FIG. 3 is a perspective view of a free standing gaming machine showing a time-based bonus game.

Referring now to FIG. 3, a gaming machine 210 includes a primary display 214 and a secondary display 216 for displaying a wagering game. The gaming machine 210 is generally similar to the gaming machines 10, 110 described above in reference to FIGS. 1A-2 and is part of a bank of gaming machines. The wagering game includes a base game, which is displayed on the primary display 214, and a time-based bonus game, which is displayed on the secondary display 216. According to an exemplary embodiment (as illustrated in FIGS. 3-7), the wagering game has a Dragon theme in which DRAGON WORLD games are conducted.

The time-based bonus game is a "portal" game that is triggered on the bank of gaming machines and is being conducted simultaneously by all eligible participating players. In general, a portal game is an independent entity (e.g., a side game) structured in such a way that it can dynamically link into, and execute in conjunction with, portal enabled base games. A portal enabled base game is, generally, a base game that supports an interface and structure that allows external independent portal games to dynamically link into the base game structure (thus, allowing the portal game to execute in conjunction with the base game). The base game is, generally, the entity that accepts wagers, commits wagers, spins the reels and pays out wins.

The primary display 214 includes at the bottom of the display a Base Wager indicator and selectors 217, for displaying and selecting a base wager, and a Play Wager indicator 219, for displaying a current wager received from a player. As explained in more detail below, the base wager and/or the play wager are factors based on which a bonus multiplier is determined.

The primary display 214 further includes at the top of the display a Bonus Time Eligibility indicator 221, which displays the amount of time that a wagered amount gives eligibility to the player for playing the bonus game. A time-slice counter is used to increment and/or decrement time slices for increasing and/or decreasing the time that the player is eligible to play the bonus game. During each increment of time, a central controller uses an RNG to determine whether the bonus game is triggered. If the player has eligibility during that increment of time, then the player is allowed to participate in the bonus game. Additional information regarding a time-based bonus game is disclosed in commonly assigned U.S. Patent Publication No. 2009-0042641 A1 (U.S. patent application Ser. No. 11/919,889), titled "Wagering Game With Time-Based Bonus" and filed on Nov. 5, 2007, which is herein incorporated by reference in its entirety. If, however, the player has no eligibility during that increment of time, then the player is not allowed to participate in the bonus game if it is triggered during that increment of time.

Referring to FIGS. 4A-4E, the bonus game will be explained in more detail. Every time the player makes a bet (also referred to as a play wager) on the base game, a Dragon 223 appears on the secondary display 216. The Dragon 223 is a virtual pet that is likely to increase player game loyalty. The Dragon 223 has a bonus multiplier that is based on a Base Wager, which is a set amount for the bank of gaming machines. The Base Wager is set by an operator, e.g., an operator of a casino establishment. The bonus multiplier is optionally displayed on the belly of the Dragon 223.

When the Dragon 223 appears, it is available for a specific period of time, e.g., 9 seconds of eligibility. The Dragon 223 is displayed flying on the secondary display 216. Whenever the Dragon 223 is flying, the players on the bank of gaming machines are eligible for the bonus game. Coin-in information, e.g., play wagers, received from the players is used to award eligibility time based on an already set-up function.

The bonus game is randomly triggered. Coins 224 having different credit values fall over the secondary display 216. Based on a randomly selected occurrence, the Dragon 223 swoops in and eats a coin 224 for a credit award. If the dragon collects a special bonus coin from coins 224, the player wins a bonus game. The bonus game may be a huge shower of coins, a chance to receive multiple coins, additional bonus eligibility time, and/or other traditional bonus features. Other traditional bonus features may include free spins, picking games, progressive prizes, and credit prizes.

Figure 4A:
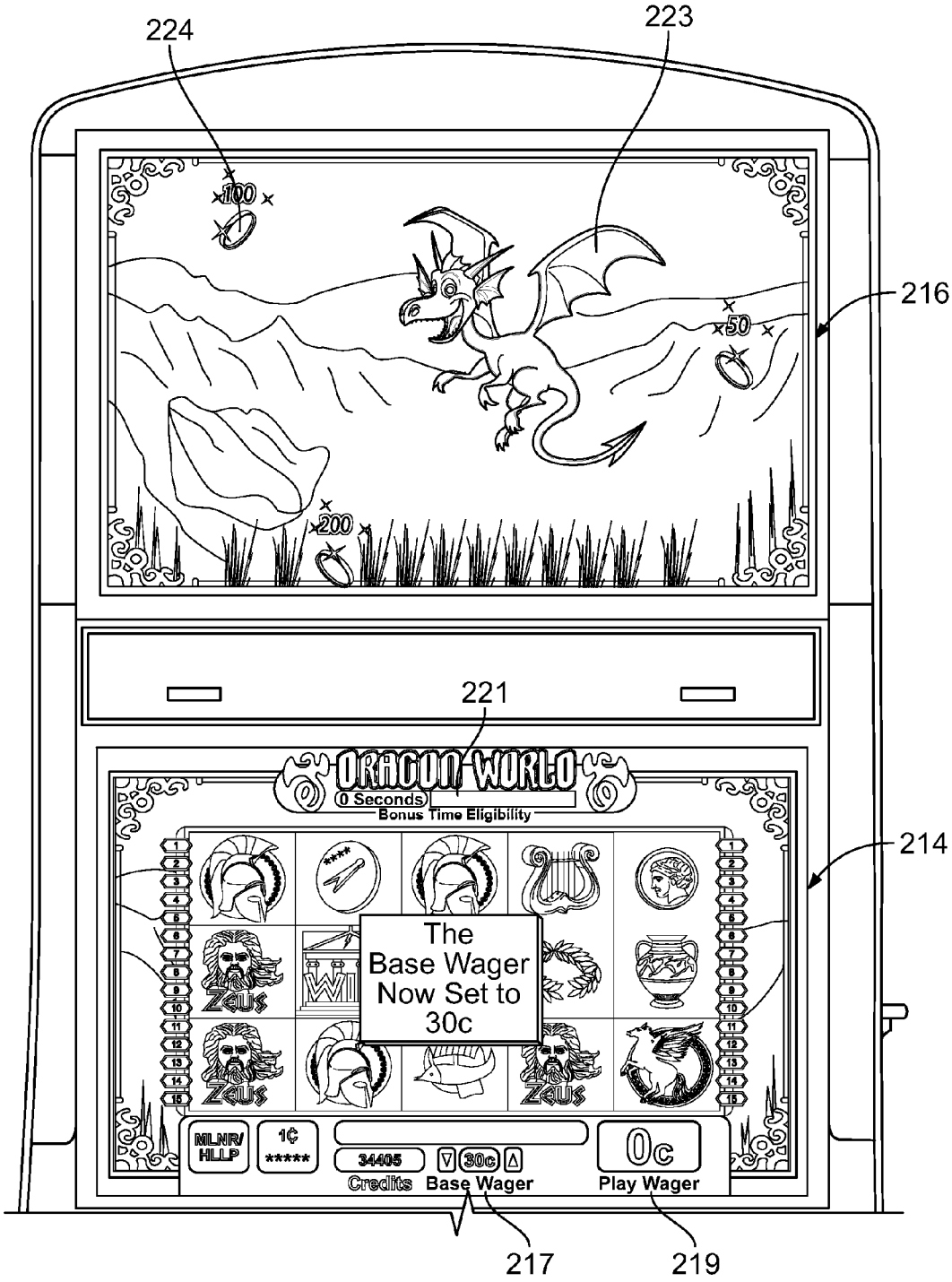
FIG. 4A is a front view of a primary and secondary display of the gaming machine of FIG. 3 displaying setup of a base wager for the time-based bonus game.

As shown in FIG. 4A, according to one example, the operator has set the Base Wager to 30 credits. At this moment, the player has not provided a play wager. As such, the Play Wager indicator 219 shows zero credits. Furthermore, the Time Eligibility indicator 221 shows that the player has not accumulated any bonus eligibility time yet.

Figure 4B:
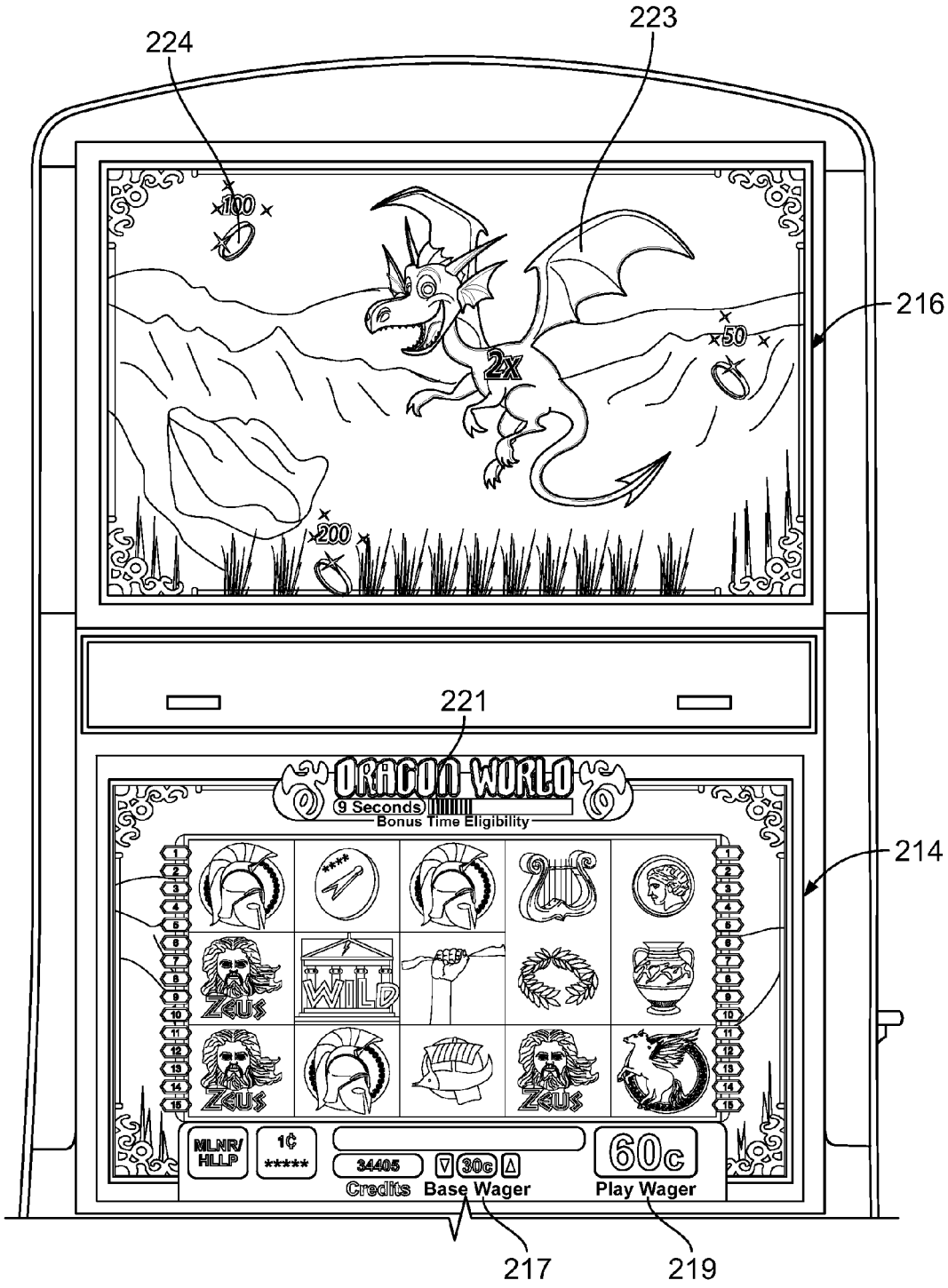
FIG. 4B shows the time-based bonus game of FIG. 3 after a player has made a first wager.

Referring to FIG. 4B, the player has now wagered 60 credits, as displayed in the Play Wager indicator 219. The play wager of 60 credits provides the player with 9 seconds of bonus eligibility time (displayed by the Time Eligibility indicator 221) and a bonus multiplier of 2× (displayed on the Dragon 223). The bonus eligibility time can be a set amount of time that is independent of the play wager. For example, the player may receive 9 seconds of bonus eligibility time regardless of whether the player wagers 60 credits or 200 credits.

Alternatively, the bonus eligibility time can be based on the play wager, e.g., 60 credits will provide 9 seconds of bonus eligibility time and 200 credits will provide 30 seconds of bonus eligibility time. Optionally, the dependence of the bonus eligibility time on the play wager can vary in a linear and/or non-linear manner.

The bonus multiplier is generally equivalent to a whole number multiple of the play wager with respect to the base wager. For example, the play wager of 60 credits is twice the amount of the base wager of 30 credits. Thus, the bonus multiplier is equal to 2×. In other words, the relationship can be expressed as follows:

$$\text{BASE WAGER}=B \qquad \text{Expression 1}$$

$$\text{WHOLE NUMBER MULTIPLE}=N \qquad \text{Expression 2}$$

$$\text{PLAY WAGER (Whole Number)}=N*b \qquad \text{Expression 3}$$

$$\text{BONUS MULTIPLIER}=N \qquad \text{Expression 4}$$

Thus, the base wager of 30 credits and the play wager of 60 credits provides a bonus multiplier of 2× because the whole number multiple of the play wager relative to the base wager is 2. If the play wager is less than the base wager, the bonus multiplier may not be awarded or may remain as a 1× multiplier.

Optionally, the size of the Dragon 223 changes in size in accordance with changes to the bonus multiplier. For example, the size of the Dragon 223 has increased in size relative to the size displayed in FIG. 4A.

Figure 4C:
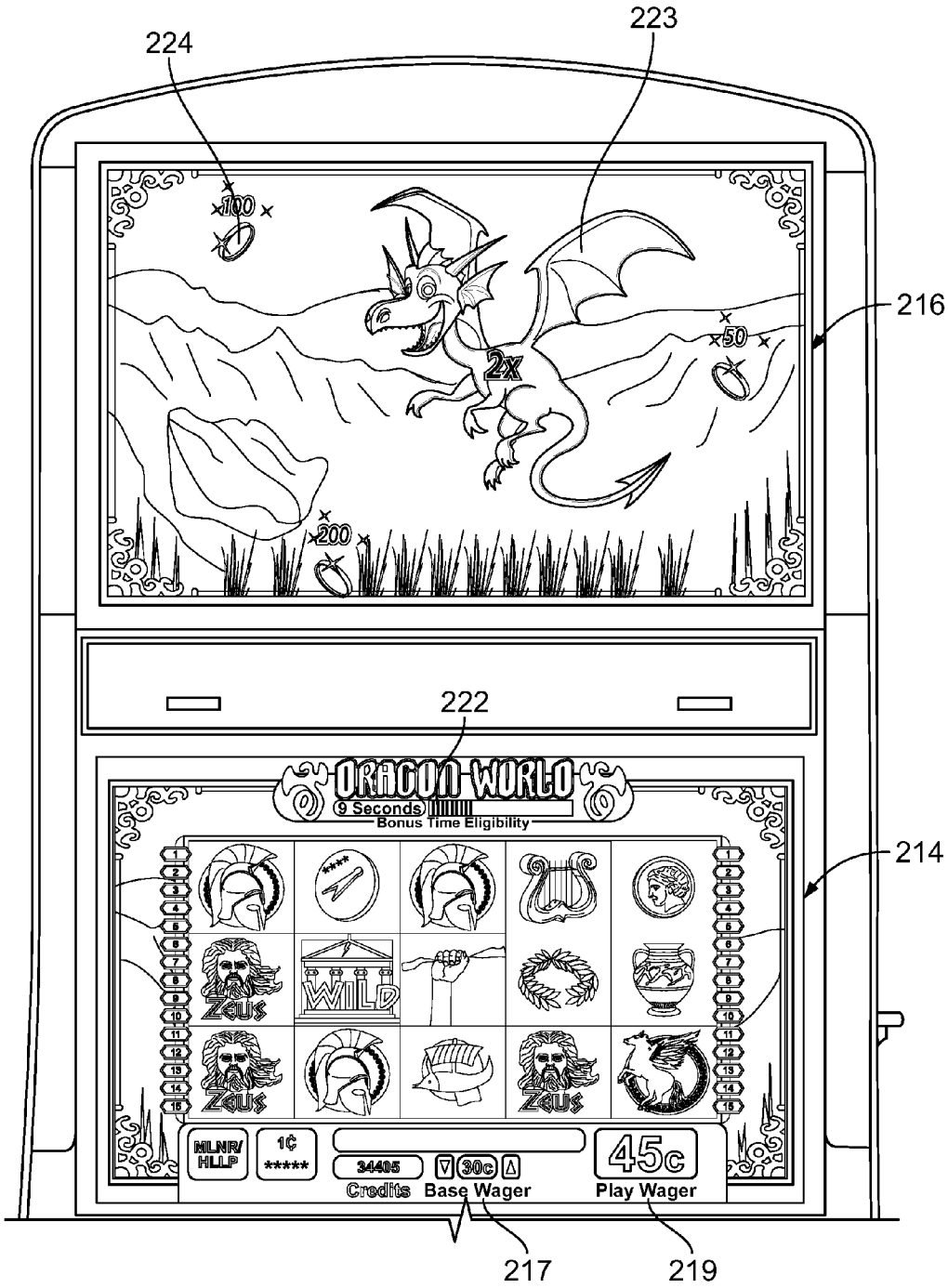
FIG. 4C shows the time-based bonus game of FIG. 3 after the player has made a second wager.

Referring to FIG. 4C, the player has made a play wager of 45 credits (displayed in the Play Wager indicator 219). Because the play wager of 45 credits contains a fraction (also referred to as a non-whole number multiple) of the base wager of 30 credits, the bonus multiplier has a chance of being either a higher number or a lower number than the bonus multiplier corresponding to the whole number multiple of the play wager.

Another way of expressing the relationship between a play wager that includes a fraction of the base wager and the bonus multiplier is as follows:

$$\text{BASE WAGER}=B \qquad \text{Expression 5}$$

$$\text{WHOLE NUMBER MULTIPLE}=N \qquad \text{Expression 6}$$

$$\text{FRACTION}=Z \qquad \text{Expression 7}$$

$$\text{PLAY WAGER (Whole Number and Fraction)}=Z+N*B \qquad \text{Expression 8}$$

As such, it follows that the fraction of the base wager contained in the play wager can also be expressed as follows:

$$Z=\text{PLAY WAGER}-N*B \qquad \text{Expression 9}$$

The probability for increasing the bonus multiplier X to a next higher bonus multiplier value can be expressed as follows:

$$\text{PROBABILITY PERCENTAGE}=|Z|/B*100 \qquad \text{Expression 10}$$

Thus, the probability for increasing the bonus multiplier X to a next higher bonus multiplier value is based on a positive value of the fraction Z divided by the base wager (and multiplied by 100 to obtain the probability percentage).

Thus, referring to the exemplary embodiment of FIG. 4C, the base wager is 30 credits, the play wager is 45 credits, N is 1, and Z is 15. Accordingly, the player is guaranteed to receive a bonus multiplier of 1×, because N is equal to 1. However, the player has a 50% chance of receiving a next higher multiplier because the player has wagered an additional 15 credits over the base wager of 30 credits. It follows that the player has a 50% chance of remaining at the 1× multiplier. According to one embodiment, the bonus multipliers increase in value by one:

$$N'=N+1 \qquad \text{Expression 11}$$

Thus, the next higher bonus multiplier N' is equal to N (the guaranteed bonus multiplier) plus 1. Accordingly, in the above example the player has a 50% chance of receiving a 2× multiplier (wherein N'=1+1).

Figure 4D:
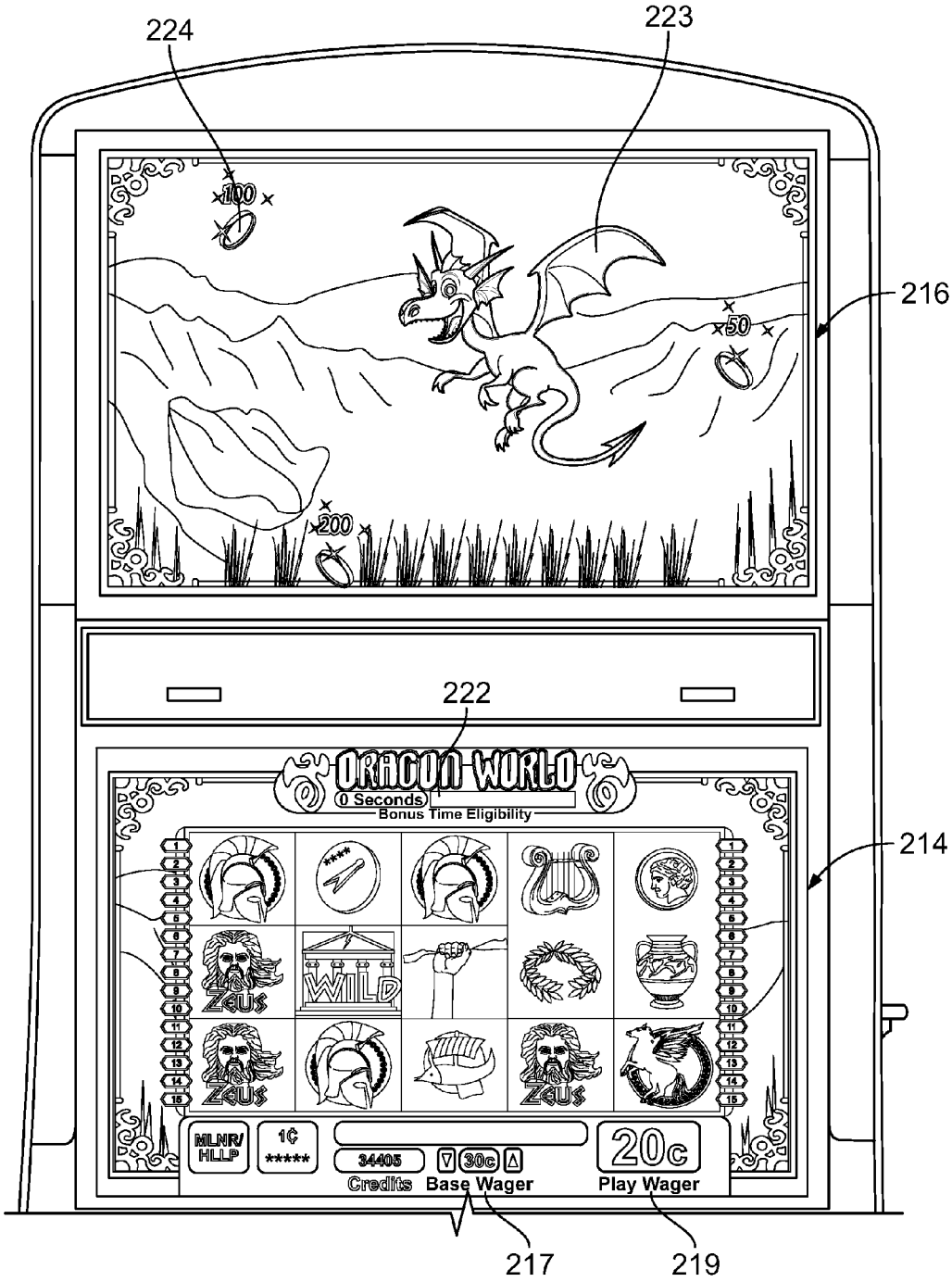
FIG. 4D shows the time-based bonus game of FIG. 3 after the player has made a third wager.

Referring to FIG. 4D, the player has made a play wager of 20 credits (displayed in the Play Wager indicator 219). Because the play wager of 20 credits is smaller than the base wager of 30 credits, the player does not receive any bonus eligibility time. Also, the player is not guaranteed a bonus multiplier. However, in accordance with Expressions 5-11 presented above, the player has a 66% chance of obtaining a 1× multiplier. Furthermore, the size of the Dragon 223 has now decreased back to its original size (similar to the size displayed in FIG. 4A).

It is understood that the bonus multiplier values in the above examples can vary according to any functional relationship between the base wager and the play wager. The one-to-one relationship between bonus multiplier and the whole number multiple has been described for ease of understanding. Clearly, a 1× multiplier is practically the same as if the player has received no multiplier (i.e., an award multiplied by 1× is the same as an award that is not multiplied by 1×). However, the expressions and examples using a 1× multiplier provide a simple way of understanding the weighted probability feature of the current application. According to alternative embodiments, the bonus multiplier can have different values:

BONUS MULTIPLIER=$N$*2 Expression 12

BONUS MULTIPLIER=$N$*3 Expression 13

BONUS MULTIPLIER=$N$+1 Expression 14

BONUS MULTIPLIER=$N$+2 Expression 14

Any other function can be used to determine the bonus multiplier as a function of the whole number multiple.

Referring to FIG. 4E, various examples show the weighted probability of receiving a particular multiplier. In each example, the base wager has been set by the operator to 30 credits. For example, a play wager of 10 credits results in a weighted probability of 33% that the player will receive a 1× multiplier and 66% that the player will not receive a multiplier (e.g., the award received in the bonus game will not be multiplied by any multiplier). In another example, a play wager of 40 credits results in a 33% chance that the player will receive a 2× multiplier and a 66% chance that the player will remain with the guaranteed 1× multiplier.

Although a 1× multiplier has the same effect as no multiplier (i.e., an award multiplied by "1" will results in the same result as an award that is not multiplied by any multiplier), the 1× multiplier has been referred to, in general, for example purposes. Thus, according to one embodiment a default of a 1× multiplier is provided to the player regardless of the player wager. In other words, providing no multiplier is not the same thing as providing a "zero" multiplier (which, mathematically, would result in a "zero" award).

Figure 5:
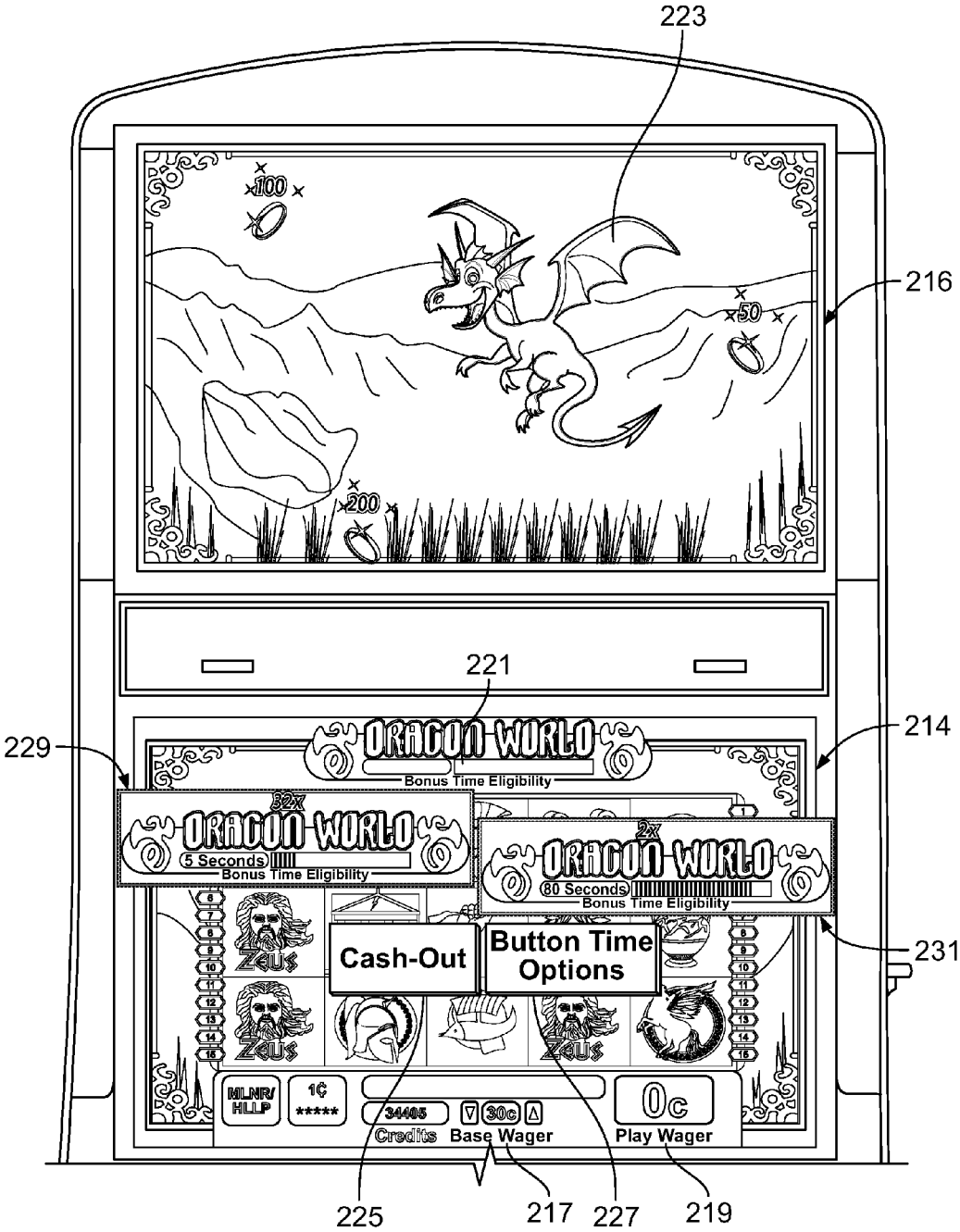
FIG. 5 shows a menu of player-selectable time-burst options for the time-based bonus game of FIG. 3.

Referring to FIG. 5, a player is provided with a selection menu, e.g., a pop-up window, of time-burst options for modifying a current bonus multiplier in response to modifying available bonus eligibility time. To keep the player from having to wait until all the remaining bonus eligibility time is finished, the player can select an onscreen button to play all the remaining bonus eligibility time in a quick time burst.

For example, a player can press a Cash-Out button 225 that will result in the display of a Button Time Options button 227. If the player would like to spend any remaining bonus eligibility time in a quick manner, the player can press the Button Time Options button 227 to display one or more options. For example, the player may select a first time-burst option 229 in which a 32× multiplier is available for 5 seconds of bonus time, or a second time-burst option 231 in which a 2× multiplier is available for 80 seconds of bonus time. Optionally, the Button Time Options button 227 can be available directly to the player as a separately displayed button on the primary display 214.

According to an alternative embodiment, the time-burst options may be available to the player only when the player's bonus eligibility time is sufficient to meet a specific threshold. For example, the player is allowed to exercise one or more of the time-burst options only if the player has built up at least 20 seconds worth of bonus eligibility time.

According to another alternative embodiment, the available bonus eligibility time is evenly divided into as many buckets as the player may want to play off at once. For example, 90 seconds of bonus eligibility time can be divided into 10 buckets of 9 seconds or into 5 buckets of 18 seconds. In another example, the player may have only one option—to play off the bonus eligibility time that has been automatically divided into a set number of buckets (e.g., 12 buckets of 9 seconds).

Figure 6:
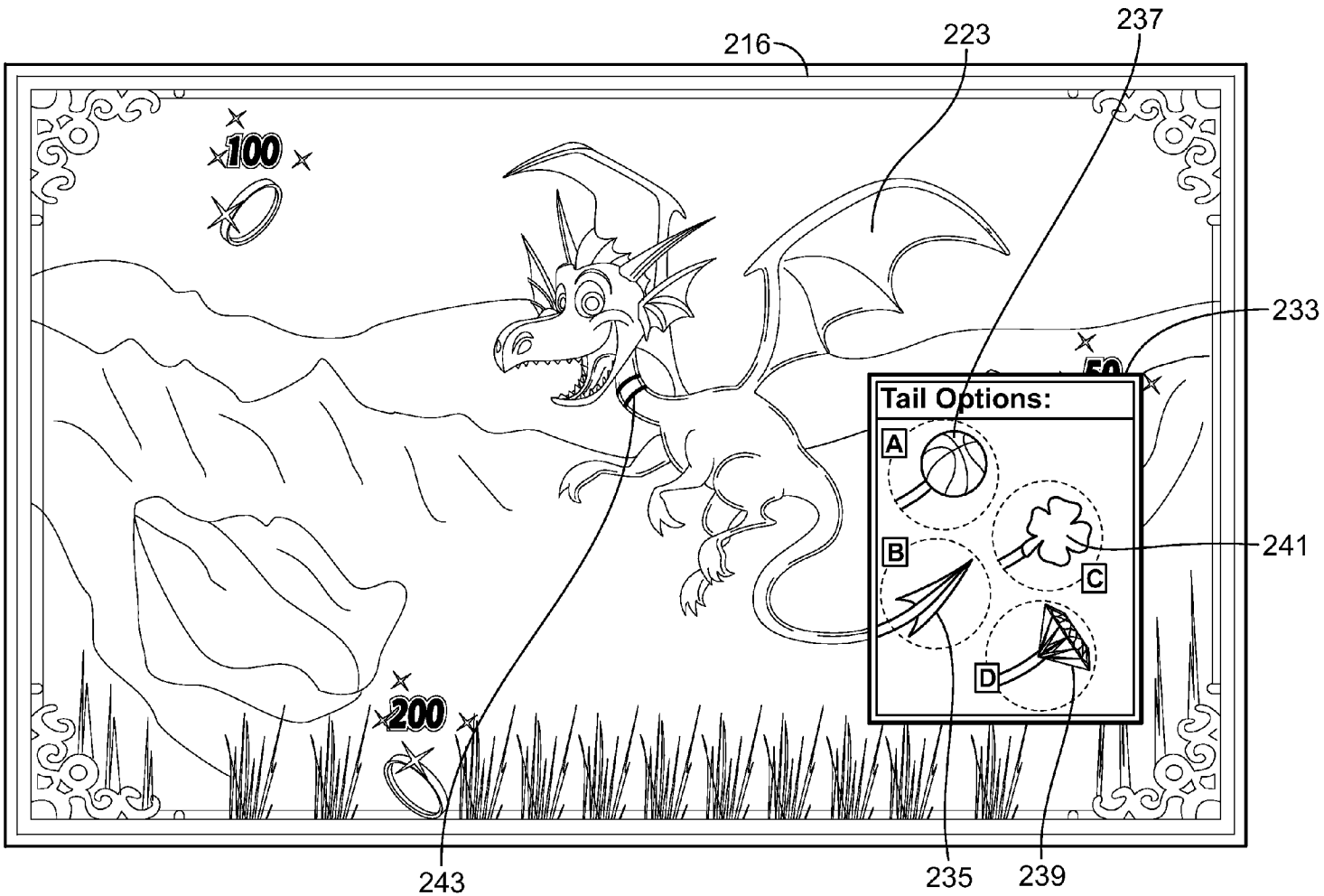
FIG. 6 shows a menu of custom options for the time-based bonus game of FIG. 3.

Referring to FIG. 6, the player can customize the Dragon 223 based on game play results. As described above, the size of the Dragon 223 may vary based on the player's wagers. The color and other physical characteristics of the Dragon 223 can be selected by the player. The player can begin customizing the Dragon 223 on bill entry. Additional customization options can be offered based on various game play results, including wins.

For example, upon receiving a winning outcome the player is presented with a customization menu 233 in which the player can select one of four different tail ends for the dragon, including an arrow 235, a ball 237, a gem 239, and a 4-leaf clover 241. The customizations are likely to keep players connected to their dragons and, also, commemorate their past wins. In another example, every big win can allow the player to add a stripe 243 to the dragon's neck. In alternative embodiments, different locations can become available to the player (e.g., a tropical island, an enchanted forest, etc.).

Optionally, the customized dragon can be saved in a persistent state account, e.g., a player account, for use in a subsequent gaming session. For example, whenever the player wishes to terminate a current gaming session (e.g., cash-out and leave the gaming machine), the customized dragon is saved to the player's gaming account. When the player returns to initiate another gaming session, the saved customized dragon can be retrieved by the player.

Figure 7:
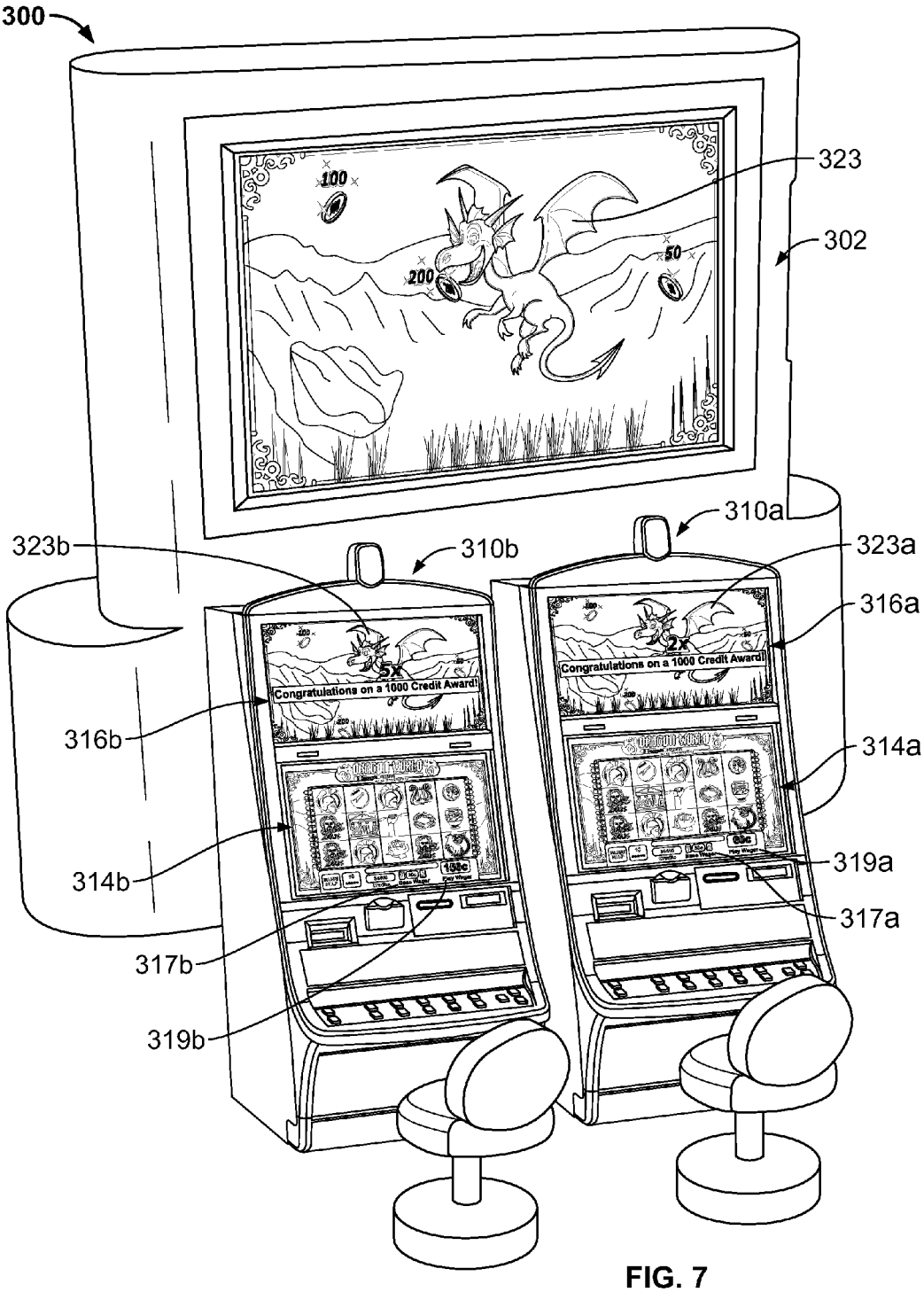
FIG. 7 shows a bank of gaming machines conducting a time-based bonus game in which each player on the bank receives an individual award.

Referring to FIG. 7, a bank of gaming machines 300 includes a signage display 302 and at least two gaming machines, which include Gaming Machine A 310*a* and Gaming Machine B 310*b*. Similar to the gaming machine 210 described above in reference to FIGS. 3-6, Gaming Machine A 310*a* and Gaming Machine B 310*b* include a corresponding primary display 314*a*, 314*b*, a secondary display 316*a*, 316*b*, a Base Wager indicator 317*a*, 317*b*, and a Play Wager indicator 319*a*, 319*b*.

The gaming machines of the bank 300 participate in the time-based bonus game, which is also known as a community bonus game. A master machine triggers the time-based bonus game for all the gaming machines, and the participating gaming machines share game outcomes and/or player decisions. Each gaming machine on the bank 300 participates in accordance with the bonus eligibility time that each machine determines locally.

A Player A is conducting a wagering game on Gaming Machine A 310*a* and a Player B is conducting a wagering game on Gaming Machine B 310*b*. When the bonus game is triggered, a main Dragon 323 is displayed on the signage display 302 and generally identical Dragons 323*a*, 323*b* are displayed on each secondary display 316*a*, 316*b* of the gaming machines 310*a*, 310*b*.

Both players (Player A and Player B) are playing the same bonus game. As such, the Dragon 323, 323*a*, 323*b* acts the same on all the displays 302, 316*a*, 316*b*. For example, if the Dragon 323 on the signage display 302 selects a 200 credit coin, the same act and result is displayed on the display of each participating gaming machine, including the secondary displays 316*a*, 316*b* on which Player A and Player B are conducting the bonus game. However, the final award is an individual award that is specific to the player based on the player's play wager and/or other factors.

Players may or may not get the same credit award as other players, even taking a multiplier in account. Optionally, players may potentially receive different awards. Because each player is generally watching their own Dragon, the players are likely to focus on their own individual results. As such, the bonus game tends to foster an individualized type of gameplay (e.g., where each player is not generally affected by outcomes of other players), in contrast to a community-type of game (e.g., where each player may be generally affected by outcomes of another player).

For example, the individual award of Player A is a 400 credit award and the individual award of Player B is a 1,000 credit award. Although the base award is the same for each player, i.e., 200 credits, the final individual award is different because it is a function of the individual bonus multiplier of each player (which is a function of the play wager received from each player). Player A has wagered 60 credits (as displayed in the Play Wager indicator 319*a*). Because the base wager is 30 credits (as displayed in the Base Wager indicator 317*a*), the multiplier of Player A is a 2× multiplier. This results in the final award of 400 credits for Player A. Player B has wagered 150 credits (as displayed in the Play Wager indicator 319*b*), which results in a 5× multiplier for Player B. This results in the final award of 1,000 credits for Player B.

In an alternative embodiment, the base game may communicate to the bank that the player is already in a player-specific bonus game. The player may receive an option at the start of the player-specific bonus game to pay for maintaining current bonus eligibility time. In other words, the player may choose to "save" the current bonus eligibility time for the time-based bonus game that is triggered on the bank (not on an individual gaming machine). Alternatively, payment for maintaining eligibility can be subtracted from the player's bonus wins. Optionally, eligibility time is not capped so that the player can accumulate, in theory, enough time in a base game to cover the time-based bonus games.

Each of these embodiments and obvious variations thereof is contemplated as falling within the spirit and scope of the claimed invention, which is set forth in the following claims.

What is claimed is:

1. A gaming system for playing a wagering game, comprising:

a display for displaying a base game of the wagering game in response to receiving a play wager from a player; and a controller coupled to the display and programmed to determine a bonus multiplier and a bonus eligibility time for the player based on a base wager, at least one of the bonus multiplier and the bonus eligibility time being a function of both the base wager and the play wager, trigger a bonus game in response to a bonus triggering event, if sufficient bonus eligibility time is available to the player when the bonus game is triggered, allow the player to participate in the bonus game, provide a plurality of player-selectable options including a first option and a second option, the first option indicating a first value of the bonus multiplier associated with a first value of the bonus eligibility time, the second option indicating a second value of the bonus multiplier associated with a second value of the bonus eligibility time, the first value of the bonus multiplier being different than the second value of the bonus multiplier, the first value of the bonus eligibility time being different than the second value of the bonus eligibility time and in response to receiving a player selection of one of the options of the player-selectable options, modify current values of the bonus multiplier and the bonus eligibility time to respective values of the selected option.

2. The gaming system of claim 1, wherein additional time is added to the bonus eligibility time of the player for each additional play wager provided by the player.

3. The gaming system of claim 1, wherein the controller is programmed to present on the display a graphical animation that shows the bonus multiplier in numerical form.

4. The gaming system of claim 3, wherein the graphical animation changes size as a function of the bonus multiplier.

5. The gaming system of claim 3, wherein the graphical animation is customizable based on game play results.

6. The gaming system of claim 1, wherein the player receives an individual award that is specific to the player.

7. The gaming system of claim 1, wherein the bonus multiplier is represented via a numerical representation on the display.

8. A gaming system for playing a wagering game, comprising:

a display for displaying a base game of the wagering game in response to receiving a play wager from a player; and a controller coupled to the display and programmed to determine a bonus multiplier and a bonus eligibility time for the player based on a base wager, at least one of the bonus multiplier and the bonus eligibility time being a function of both the base wager and the play wager, trigger a bonus game in response to a bonus triggering event, if sufficient bonus eligibility time is available to the player when the bonus game is triggered, allow the player to participate in the bonus game, in response to receiving a player selection, modify the bonus multiplier based on changes to the bonus eligibility time, and provide a selection menu having a plurality of player-selectable time-burst options, each time-burst option being associated with a decrease in the bonus time eligibility and an increase in the bonus multiplier.

9. The gaming system of claim 8, wherein the selection menu is a pop-up window that is displayed in response to the player pressing a cash-out button.

10. A method of conducting a wagering game via a gaming machine, the method comprising:

receiving a play wager from a player for playing a base game of the wagering game;

in response to receiving the player wager, displaying the base game on a display of a gaming machine;

based on a base wager, determining a bonus multiplier and a bonus eligibility time for the player, at least one of the bonus multiplier and the bonus eligibility time being a function of both the base wager and the play wager;

triggering a bonus game in response to a bonus triggering event, the bonus game being displayed on the display of the gaming machine or on another display of the gaming machine;

if sufficient bonus eligibility time is available to the player when the bonus game is triggered, allowing the player to participate in the bonus game;

providing a plurality of player-selectable options including a first option and a second option, the first option indicating a first value of the bonus multiplier associated with a first value of the bonus eligibility time, the second option indicating a second value of the bonus multiplier associated with a second value of the bonus eligibility time, the first value of the bonus multiplier being different than the second value of the bonus multiplier, the first value of the bonus eligibility time being different than the second value of the bonus eligibility time; and in response to receiving a player selection of one of the options of the player-selectable options, modifying current values of the bonus multiplier and the bonus eligibility time to respective values of the selected option.

11. The method of claim 10, further comprising increasing the bonus multiplier in response to the player selecting a reduction in the bonus eligibility time.

12. A method of conducting a wagering game via a gaming machine, the method comprising:

receiving a play wager from a player for playing a base game of the wagering game;

in response to receiving the player wager, displaying the base game on a display of a gaming machine;

based on a base wager, determining a bonus multiplier and a bonus eligibility time for the player, at least one of the bonus multiplier and the bonus eligibility time being a function of both the base wager and the play wager;

triggering a bonus game in response to a bonus triggering event, the bonus game being displayed on the display of the gaming machine or on another display of the gaming machine;

if sufficient bonus eligibility time is available to the player when the bonus game is triggered, allowing the player to participate in the bonus game;

in response to player adjustment to the bonus eligibility time, modifying the bonus multiplier; and selecting from a player menu one of a plurality of player-selectable time-burst options, each of the time-burst options providing a decrease in the bonus time eligibility and an increase in the bonus multiplier.

13. The method of claim 12, wherein the player menu is a pop-up menu that is automatically displayed when the player cashes out.

14. A gaming system for playing a wagering game, comprising:

a display for displaying a base game of the wagering game in response to receiving a play wager from a player; and a controller coupled to the display and programmed to receive a selection from an operator to set a base wager, determine a bonus multiplier and a bonus eligibility time for the player, each of the bonus multiplier and the bonus eligibility time being a function of both the base wager and the play wager, trigger a bonus game in response to a bonus triggering event, if sufficient bonus eligibility time is available to the player when the bonus game is triggered, allow the player to participate in the bonus game, receive a player selection of one of a plurality of player-selectable options including a first option and a second option, the first option indicating a first value of the bonus multiplier associated with a first value of the bonus eligibility time, the second option indicating a second value of the bonus multiplier associated with a second value of the bonus eligibility time, the first value of the bonus multiplier being different than the second value of the bonus multiplier, the first value of the bonus eligibility time being different than the second value of the bonus eligibility time, in response to the player selection, modify current values of the bonus multiplier and the bonus eligibility time to respective values of the selected one of the plurality of player-selectable options, and multiply any awards received in the bonus game in accordance with the bonus multiplier.

15. The gaming system of claim 14, wherein a graphical animation is presented on the display to represent the bonus multiplier, the graphical animation changing size as a function of the bonus multiplier.

16. The gaming system of claim 15, wherein the controller is further programmed to provide customization options for changing appearance aspects of the graphical animation in response to game play results.

17. The gaming system of claim 14, wherein the controller is further programmed to determine a second bonus multiplier and a second bonus eligibility time for a second player, each of the second bonus multiplier and the second bonus eligibility time being a function of both the base wager and a second play wager received from the second player, if sufficient bonus eligibility time is available for the second player when the bonus game is triggered, allow the player to participate in the bonus game, and multiply any awards received by the second player in the bonus game in accordance with the second bonus multiplier.

* * * * *